US007878126B2

(12) United States Patent
Markert et al.

(10) Patent No.: US 7,878,126 B2
(45) Date of Patent: Feb. 1, 2011

(54) PALLET SHEET WITH UPWARDLY ANGLED EDGE PORTIONS WITH OPPOSITELY ORIENTED CLEATS FOR ENHANCED GRIPPING

(75) Inventors: Gary G. Markert, Hawthorn Woods, IL (US); Ronald R. Schoenberg, Centennial, CO (US); Robert A. Ross, Denver, CO (US); Paul H. Beauregard, Bennett, CO (US); Robert F. Flynn, Littleton, CO (US)

(73) Assignee: Illinois Tool Works Inc., Glenview, IL (US)

( * ) Notice: Subject to any disclaimer, the term of this patent is extended or adjusted under 35 U.S.C. 154(b) by 239 days.

(21) Appl. No.: 11/525,847

(22) Filed: Sep. 25, 2006

(65) Prior Publication Data

US 2008/0083354 A1 Apr. 10, 2008

(51) Int. Cl.
*B65D 19/00* (2006.01)

(52) U.S. Cl. ..... 108/51.11; 108/53.1; 108/55.1

(58) Field of Classification Search ..... 248/346.02; 108/55.3, 55.1, 51.11, 52.1, 53.1, 53.3; 206/386, 206/736, 586, 597, 600, 735, 766
See application file for complete search history.

(56) References Cited

U.S. PATENT DOCUMENTS 2,256,454 A * 9/1941 Bomar ..... 414/661
2,801,065 A * 7/1957 Moir et al. ..... 248/346.4
2,906,481 A * 9/1959 Parker ..... 108/51.3
3,327,889 A * 6/1967 Dore ..... 220/6
3,472,363 A * 10/1969 Overton et al. ..... 206/597
3,621,797 A * 11/1971 Hunter ..... 108/31
3,753,407 A * 8/1973 Tilseth ..... 108/53.3
3,776,145 A 12/1973 Anderson et al.
3,850,116 A 11/1974 Mackes
3,880,286 A * 4/1975 Wegener ..... 206/597
4,042,127 A 8/1977 Brossia
4,044,981 A * 8/1977 Richter ..... 410/46
4,507,348 A 3/1985 Nagata et al.
4,906,510 A * 3/1990 Todor et al. ..... 428/182
5,029,734 A * 7/1991 Nichols ..... 222/105
5,186,336 A * 2/1993 Pippin et al. ..... 209/583
5,226,372 A 7/1993 Frenkel et al.
5,383,408 A * 1/1995 Searcy ..... 108/57.16
5,501,333 A * 3/1996 Swan ..... 206/386
5,570,643 A 11/1996 Werner
5,894,804 A 4/1999 Werner
5,972,464 A * 10/1999 Pezzuco ..... 428/100
6,186,078 B1 * 2/2001 Brown ..... 108/57.25

(Continued)

*Primary Examiner*—Janet M Wilkens
(74) *Attorney, Agent, or Firm*—Law Offices of Steven W. Weinrieb

(57) ABSTRACT

A pallet sheet has a substantially planar, centrally located base region, and a pair of upwardly angled edge portions. The upper surface portion of the pallet sheet is provided with a plurality of upwardly oriented collapsible cleats for enhancing cushioning and frictional characteristics, and in addition, upwardly and downwardly oriented cleats are also disposed upon the upper and lower surface portions of the upwardly angled edge portions so as to provide enhanced gripping characteristics for the pallet sheet by a gripper bar mechanism of a motorized transport vehicle. Still further, a support system is provided for supporting a plurality of pallet sheets thereon wherein the oppositely disposed edge portions of the pallet sheets can be maintained at their desired predetermined angle.

10 Claims, 4 Drawing Sheets

U.S. PATENT DOCUMENTS 6,550,741 B1 * 4/2003 Cottone ..... 248/678
7,013,814 B2 * 3/2006 Modesitt et al. ..... 108/51.3
2006/0272556 A1 * 12/2006 Apps ..... 108/53.1
2008/0149004 A1 * 6/2008 Markert et al. ..... 108/51.3

* cited by examiner

PALLET SHEET WITH UPWARDLY ANGLED EDGE PORTIONS WITH OPPOSITELY ORIENTED CLEATS FOR ENHANCED GRIPPING

FIELD OF THE INVENTION

The present invention relates generally to pallet sheets, and more particularly to a new and improved pallet sheet upon which cargo loads are adapted to be placed in order to effectively form palletized loads. The pallet sheet has a substantially rectangular configuration comprising a substantially planar, centrally located base region, and a pair of upwardly angled edge, lip, or tab portions which are respectively integrally formed upon, and extend along, each one of the pair of oppositely disposed, transversely oriented, relatively short ends or sides of the rectangularly configured pallet sheet so as to facilitate the engagement of the pallet sheet by means of a suitable gripper bar mechanism of a motorized transport vehicle, such as, for example, a forklift truck or the like, and wherein further, both the upper or top, and lower or bottom, surface portions of the pair of upwardly angled edge, lip, or tab portions of the pallet sheet are provided with a plurality of collapsible cleats for enhancing the gripping thereof by means of the gripper bar mechanism of the motorized transport vehicle during either pushing or pulling phases of a palletized load loading or unloading operation. In addition, the present invention also relates to a new and improved support structure for ensuring the maintenance of the upwardly angled edge, lip, or tab portions of the pallet sheet during shipping and storage.

BACKGROUND OF THE INVENTION

Pallet sheets are well known in the cargo, packaging, and transportation industries as a means for supporting cargo loads thereon during the formation of palletized load assemblies comprising the cargo loads and the underlying pallet sheets. Conventional pallet sheets of the aforenoted type are disclosed, for example, within U.S. Pat. No. 5,894,804 which issued to Werner on Apr. 20, 1999, U.S. Pat. No. 5,570,643 which issued to Werner on Nov. 5, 1996, U.S. Pat. No. 5,226,372 which issued to Frenkel et al. on Jul. 13, 1993, U.S. Pat. No. 4,507,348 which issued to Nagata et al. on Mar. 26, 1985, U.S. Pat. No. 4,042,127 which issued to Brossia on Aug. 16, 1977, U.S. Pat. No. 3,850,116 which issued to Mackes on Nov. 26, 1974, and U.S. Pat. No. 3,776,145 which issued to Anderson et al. on Dec. 4, 1973. As briefly described within U.S. Pat. No. 5,570,643 which issued to Werner, and as illustrated within FIG. 1, which substantially corresponds to FIG. 1 of the noted Werner patent, when a palletized load is to be constructed and loaded upon a motorized vehicle, such as, for example, a forklift truck or the like, a pallet sheet 10 is initially disposed upon a flat support surface 12, and a plurality of cargo packages 14 are then deposited upon the pallet sheet. A motorized transport vehicle 16 is provided with a support platen 20, and a gripper bar mechanism or assembly 18 is fixedly mounted upon a forwardly disposed vertically oriented framework member 21 which, in turn, is movably mounted upon a rearwardly disposed vertically oriented framework member 23 by means of a pantagraph assembly 25. The gripper bar mechanism or assembly 18 is adapted to grip or grasp a lip portion 36 of the pallet sheet 10 so as to effectively move the palletized load 10,14 onto the support platen 20, or alternatively, the support platen 20 may effectively be moved underneath the palletized load 10,14 while the palletized load 10,14 is effectively held in a slightly upwardly raised and tilted orientation as a result of the gripper bar mechanism or assembly 18 gripping or grasping the lip portion 36 of the pallet sheet 10.

It is additionally noted that the central or main body portion of the pallet sheet 10 is provided with a plurality of upwardly projecting nubs or protrusions, however, the upwardly projecting nubs or protrusions are not provided or disposed upon the lip member 36 of the pallet sheet 10. In fact, none of the aforenoted patents, directed toward the various pallet sheets, disclose the use of such protrusions, nubs, dimples, or the like, upon any of their respectively inclined or angled edge, lip, or tab members, with the exception of the patent to Frenkel et al., however, the patent to Frenkel et al. discloses the use of dimple structure only upon one of its lip members. Still further, the dimple structure is disposed only upon the undersurface portion of the one lip member, and no reason is provided within the Frenkel et al. patent as to why the dimples are provided only upon the one lip member of the pallet sheet, what purpose such dimples serve as a result of being disposed only upon the one lip member of the pallet sheet, or why such dimples are provided only upon the undersurface portion of the one lip member of the pallet sheet.

Continuing still further, it has been experienced that, in conjunction with such conventional pallet sheets, as exemplified by means of the Werner or Frenkel et al. patents, it is sometimes difficult for the gripper bar mechanism to in fact engage the upwardly angled edge, lip, or tab portion of the pallet sheet in such a manner as to be capable of fixedly or securely gripping or grasping the pallet sheet in preparation for the performance of a palletized load pulling or pushing operation. Accordingly, it is sometimes difficult for the gripper bar mechanism to in fact readily or reliably achieve a particular pulling or pushing operation with respect to the palletized load in order to, for example, pull the palletized load onto the support platen of the motorized transport vehicle when the palletized load is to be transported or moved to a remote location, or to push or remove the palletized load from the support platen of the motorized transport vehicle in order to deposit the palletized load at a desired location or destination. More particularly, the gripper bar mechanism sometimes experiences slippage with respect to the upwardly angled edge, lip, or tab portion of the pallet sheet. Such slippage results in the impression, for example, of torsional forces upon the upwardly angled edge, lip, or tab portion of the pallet sheet which, in turn, leads to significant, abnormally oriented stresses being impressed upon, or generated within, such upwardly angled edge, lip, or tab portion of the pallet sheet. Accordingly, the edge, lip, or tab portion of the pallet sheet experiences fracture, propagated cracking, or breakage, which will effectively prevent the pallet sheet from being used for its intended purposes, thereby rendering the useful service life of such pallet sheets undesirably foreshortened.

Still yet further, as has been noted hereinbefore, some pallet sheets are normally fabricated with their edge, lip, or tab portions angled upwardly at a predetermined angle so as to in fact facilitate the engagement and gripping thereof by means of the gripper bar mechanism of the motorized transport vehicle. Prior to the usage of the pallet sheets, however, the pallet sheets are normally stored within a stacked array. In view of the fact, however, that the pallet sheets are fabricated from any one of various different thermoplastic materials which are not rigid, but are somewhat flexible, and which do not exhibit permanent memory characteristics, the upwardly angled edge, lip, or tab portions will not normally retain their upwardly angled orientations over an extended period of time but, to the contrary, under the influence of gravitational forces, the upwardly angled edge, lip, or tab portions will tend to become coplanar with respect to the main or central body portion of the pallet sheet. Accordingly, when a particular one of the plurality of pallet sheets is, for example, removed from the stacked array of pallet sheets, the originally upwardly angled edge, lip, or tab portions of the pallet sheet will not be disposed at its original, upwardly angled orientation so as to facilitate the engagement and gripping thereof by means of a gripper bar mechanism of a motorized transport vehicle.

A need therefore exists in the art for a new and improved pallet sheet wherein not only will the pallet sheet be capable of exhibiting or providing enhanced cushioning characteristics with respect to the cargo load, but in addition, the pallet sheet will also exhibit or provide enhanced frictional characteristics between the upper surface portion of the pallet sheet and the cargo load, and wherein still further, the pallet sheet will be capable of exhibiting or providing enhanced gripping characteristics with respect to the gripper bar mechanism of the motorized transport vehicle such that the gripper bar mechanism of the motorized transport vehicle can in fact achieve a secure and reliable grip upon the pallet sheet in connection with pushing and pulling palletized load operations. Still yet further, a need exists in the art for a means for packaging a plurality of pallet sheets, for storage and shipping, in such a manner that the upwardly angled edge, lip, or tab portions of the plurality of pallet sheets will be disposed and retained in their upwardly angled orientations so as to always be properly oriented in their upwardly angled orientations so as to facilitate the engagement and gripping of the upwardly angled edge, lip, or tab portions of the pal-let sheets by means of a gripper bar mechanism of a motorized transport vehicle.

SUMMARY OF THE INVENTION

The foregoing and other objectives are achieved in accordance with the teachings and principles of the present invention through the provision of a new and improved pallet sheet which has a substantially rectangular configuration and which comprises a substantially planar, centrally located base region, and a pair of upwardly angled edge, lip, or tab portions which are respectively integrally formed upon, and extend along, each one of the pair of oppositely disposed, transversely oriented, relatively short ends or sides of the rectangularly configured pallet sheet so as to facilitate the engagement of the pallet sheet by means of a suitable gripper bar mechanism of a motorized transport vehicle, such as, for example, a forklift truck or the like. The upper or top surface portion of the pallet sheet is provided with a plurality of collapsible cleats wherein the upwardly oriented cleats disposed upon the upper or top surface portion of the pallet sheet provide enhanced cushioning and frictional characteristics between the pallet sheet and the cargo load. Still further, upwardly and downwardly oriented cleats are disposed upon the upper or top, and lower or bottom, surface portions of the upwardly angled edge, lip, or tab portions of the pallet sheet so as to provide enhanced gripping characteristics for the pallet sheet when one of the upwardly angled edge, lip, or tab portions is grippingly engaged by means of the gripper bar mechanism of the motorized transport vehicle during either the pulling or pushing phase of a palletized load loading or unloading operation.

Still yet further, a support system, in the form of, for example, a cargo support pallet, is provided for supporting a plurality of pallet sheets thereon. Oppositely disposed end portions of the cargo pallet are respectively provided with an angled structure, which may comprise, for example, an inverted angle board or angle iron, wherein the apex portions of the angle boards, angle irons, or angled structures are oriented upwardly. In this manner, when the oppositely disposed edge, lip, or tab portions of the plurality of pallet sheets are disposed upon upwardly angled surface portions of the angle irons, angle boards, or angled structures, the oppositely disposed edge, lip, or tab portions will be angled upwardly at a desired predetermined angle.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 2:
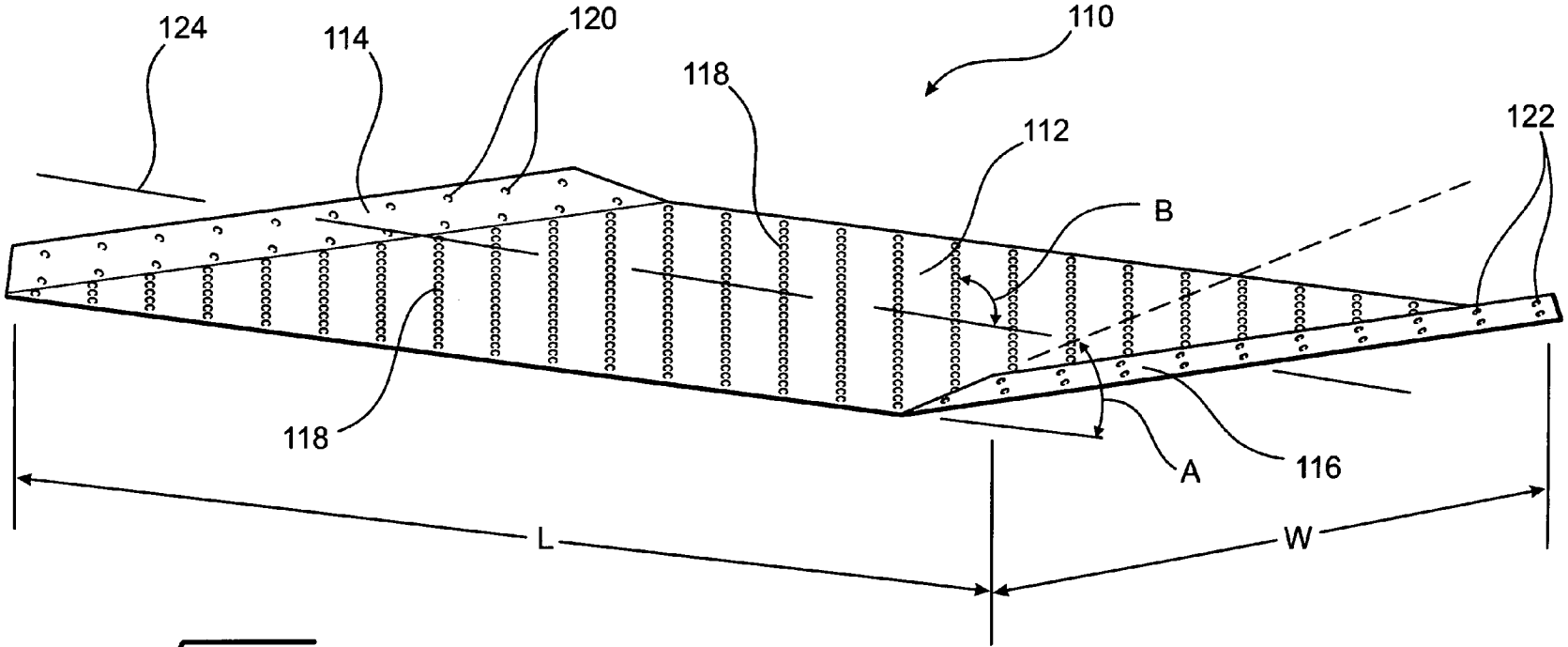
FIG. 2 is a top perspective view of a first embodiment of a new and improved pallet sheet as constructed in accordance with the principles and teachings of the present invention and showing the cooperative parts thereof, wherein, in particular, the cleats, disposed upon the upper surface portion of the main central body portion of the pallet sheet, are arranged within a predetermined pattern comprising a plurality of rows which are disposed at a predetermined angle with respect to the longitudinal axis of the pallet sheet.

Referring now to the drawings, and more particularly to FIG. 2 thereof, a first embodiment of a new and improved pallet sheet, as constructed in accordance with the principles and teachings of the present invention and showing the cooperative parts thereof, is disclosed and is generally indicated by the reference character 110. More particularly, it is seen that the pallet sheet 110 may be fabricated from a suitable thermoplastic material, such as, for example, a polyolefin material, or a blend thereof, which would include, for example, polyethylene, polypropylene, or the like, or from a suitable fibrous/paper material, or from a combination of fibrous/ paper and thermoplastic materials, and that the thickness dimension of the pallet sheet 110 can be within the range of fifteen thousandths of an inch to one hundred twenty thousandths of an inch (0.015-0.120"). In addition, it is also seen that the pallet sheet 110 has a substantially rectangular structure comprising a pair of oppositely disposed relatively long sides, and a pair of oppositely disposed relatively short ends, wherein, for example, the pallet sheet 110 has an overall length dimension L of approximately fifty-one inches (51.00") and an overall width dimension W of approximately forty-three inches (43.00"), although other sized pallet sheets 110 are of course possible. It is further seen that the pallet sheet 110 comprises a primary central planar portion 112 and a pair of oppositely disposed, transversely oriented edge, lip, or tab portions or members 114,116 which are disposed upon the pair of oppositely disposed relatively short ends of the primary central planar portion 112. The pair of oppositely disposed, transversely oriented edge, lip, or tab portions or members 114, 116 are angled upwardly at a predetermined angle A with respect to the primary central planar portion 112, wherein the predetermined angle A can be within the range, for example, of 15°-45°, with the angle preferably being approximately 30°.

Continuing further, and in accordance with the unique and novel features or teachings characteristic of the present invention, not only are a plurality of outwardly projecting or convex collapsible or compressible cleats 118 provided upon the upper surface portion of the primary central planar portion 112 of the pallet sheet 110, but in addition, a plurality of outwardly projecting or convex collapsible or compressible cleats 120,122 are provided upon both the upper and lower surface portions of the pair of oppositely disposed, transversely oriented edge, lip, or tab members 114,116. The collapsible or compressible cleats 118,120,122 may have a height or thickness dimension, as measured above the upper surface portion of the primary central planar portion 112, and as measured above and below the upper and lower surface portions of the pair of oppositely disposed, transversely oriented edge, lip, or tab members 114,116, which is within the range of, for example, fifteen to twenty-five thousandths of an inch (0.015-0.025"), with the height or thickness dimension preferably being approximately twenty-thousandths of an inch (0.020"). By disposing the upwardly projecting collapsible or compressible cleats 118 upon the upper or top surface region of the primary central planar portion 112 of the pallet sheet 110, the cargo packages placed upon the upper or top surface portion of the primary central planar portion 112 of the pallet sheet 110 will effectively be provided with a predetermined amount of cushioning characteristics.

In addition, when the cargo packages are in fact placed upon the upper surface portion of the primary central planar portion 112 of the pallet sheet 110, the plurality of upwardly projecting collapsible cleats 118 will undergo a partial collapse or compression which will effectively provide the overall upper surface region of the primary central planar portion 112 of the pallet sheet 118 with irregular or non-uniform surface characteristics which will serve to effectively enhance the frictional surface characteristics as defined between the upper surface portion of the primary central planar portion 112 of the pallet sheet 110 and the undersurface portions of the cargo packages. In this manner, once the cargo packages have been placed upon the upper surface region of the primary central planar portion 112 of the pallet sheet 110, the enhanced frictional characteristics, as defined between the upper surface region of the primary central planar portion 112 of the pallet sheet 110 and the undersurface portions of the cargo packages, will effectively serve to prevent any inadvertent and undesirable movement of the cargo packages with respect to the upper surface region of the primary central planar portion 112 of the pallet sheet 110 so as to prevent the cargo packages from slipping, falling off, or being dislodged from the upper surface portion of the primary central planar portion 112 of the pallet sheet 110. In accordance with this first embodiment of the pallet sheet 110 of the present invention, it is noted that the plurality of cleats 118 are disposed within parallel rows which are disposed at a predetermined angle B with respect to the longitudinal axis 124 of the pallet sheet 110, such as, for example, 45°.

Figure 1:
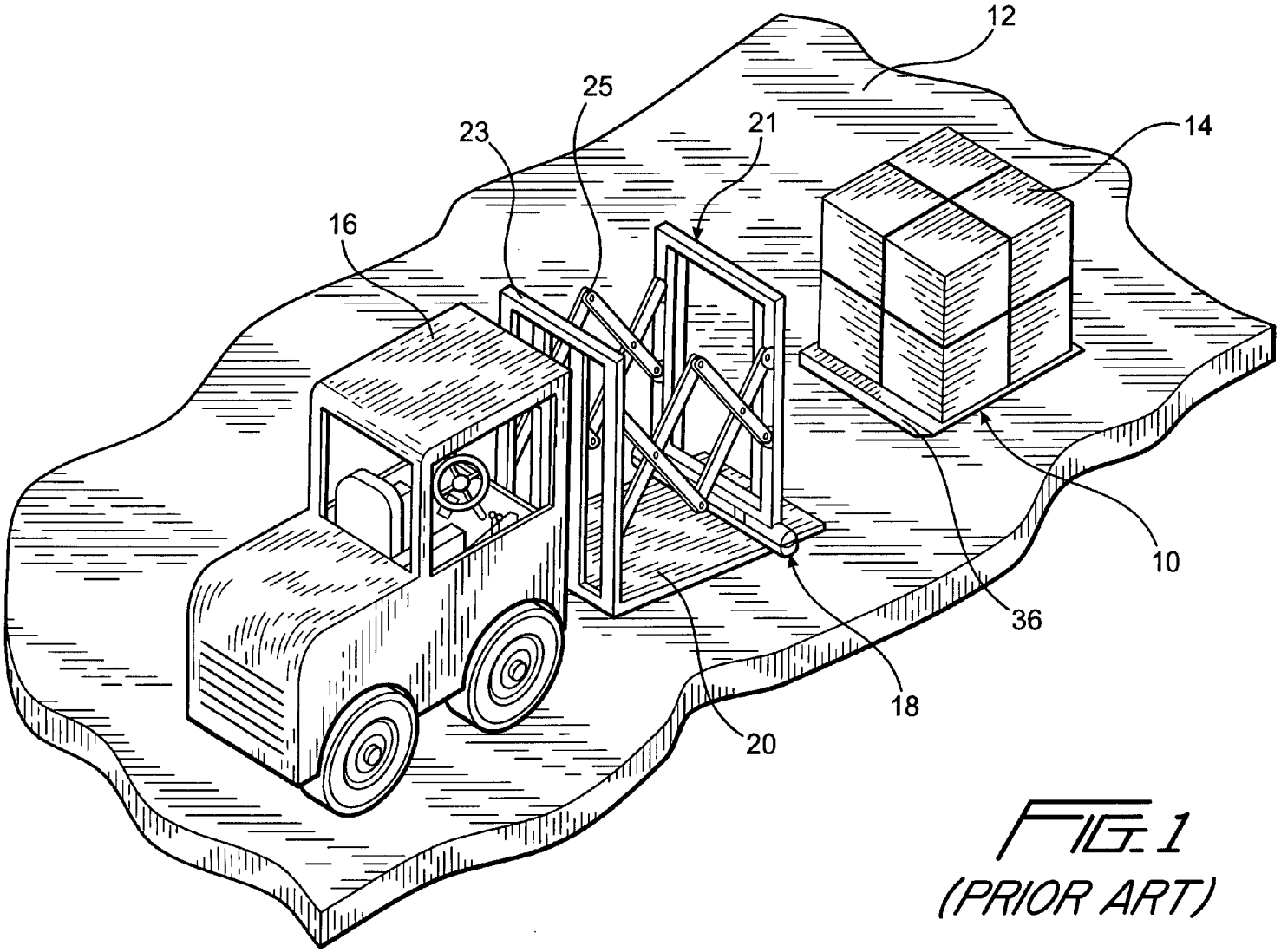
FIG. 1 (PRIOR ART)
FIG. 1 is a perspective view of conventional, PRIOR ART palletized load assembly transportation system wherein a motorized transport vehicle is utilized to move a palletized load comprising a pallet sheet upon which cargo load has been disposed.

It is noted that while the pallet sheet 110 of the present invention is provided with the aforenoted upwardly projecting collapsible or compressible cleats 118 upon the upper or top surface region of the primary central planar portion 112, a plurality of similar, downwardly projecting collapsible or compressible cleats 118 may likewise be provided upon the lower or undersurface region of the primary central planar portion 112 of the pallet sheet 110 whereby the pallet sheet 110, as well as the overall palletized load comprising the pallet sheet 110 and the cargo packages placed thereon in a manner similar to that disclosed within FIG. 1, is effectively provided with enhanced cushioning characteristics. In addition, when the cargo packages are in fact placed upon the upper surface portion of the primary central planar portion 112 of the pallet sheet 110, the plurality of downwardly projecting collapsible or compressible cleats 118 will undergo a partial collapse or compression which will effectively provide the overall undersurface region of the primary central planar portion 112 of the pallet sheet 118 with irregular or non-uniform surface characteristics which will serve to enhance the frictional surface characteristics effectively defined between the undersurface portion of the palletized load and the support platen of a motorized transport vehicle. In this manner, once the gripper bar mechanism or assembly of the motorized transport vehicle grasps or grips the palletized load and moves it onto the support platen of the motorized transport vehicle, the enhanced frictional characteristics, as effectively defined between the undersurface portion of the palletized load and the support platen of a motorized transport vehicle, will effectively serve to prevent any inadvertent and undesirable movement of the palletized load with respect to the support platen of the motorized transport vehicle so as to prevent the palletized load from slipping, falling off, or being dislodged from the support platen of the motorized transport vehicle. It is also noted that in the case where the motorized transport vehicle effectively comprises a forklift truck wherein, in lieu of having a substantially planar support platen, the forklift truck comprises a pair of laterally spaced fork tines onto which the gripper bar mechanism or assembly will move the palletized load, some of the downwardly projecting collapsible or compressible cleats 118, not seated atop the fork tines of the forklift truck, will be interposed between the fork tines so as to likewise effectively prevent any lateral slippage or movement of the palletized load with respect to the fork tines of the fork lift truck. This is similarly the case where the palletized load, comprising the pallet sheet 110 and the cargo packages placed thereon, is placed upon a wooden or plastic pallet decking formed by transversely spaced boards.

Continuing still further, and in accordance with the provision of the plurality of outwardly projecting or convex collapsible or compressible cleats 120,122 respectively provided upon both the upper and lower surface portions of the pair of oppositely disposed, transversely oriented edge, lip, or tab portions 114,116, it has been noted that the height or thickness dimension of the collapsible or compressible cleats 120, 122, as measured above and below the upper and lower surface portions of the pair of oppositely disposed, transversely oriented edge, lip, or tab portions 114,116, is within the range of, for example, fifteen to twenty-five thousandths of an inch (0.015-0.025"). It can therefore be appreciated that an additional thickness dimension of between thirty and fifty thousandths of an inch (0.030-0.050") has effectively been added to the thickness dimension of each one of the pair of oppositely disposed, transversely oriented edge, lip, or tab portions 114,116. Accordingly, when the gripper bar mechanism or assembly of the motorized transport vehicle grasps or grips one of the pair of oppositely disposed, transversely oriented edge, lip, or tab portions 114,116, a greater thickness of material comprising each one of the pair of oppositely disposed, transversely oriented edge, lip, or tab portions 114,116 will effectively be presented to the gripper bar mechanism or assembly of the motorized transport vehicle so as to facilitate and ensure the secure gripping or grasping of the particular one of the pair of oppositely disposed, transversely oriented edge, lip, or tab portions 114, 116 by means of the gripper bar mechanism or assembly of the motorized transport vehicle.

It is also to be noted that as a result of the use of the pallet sheet 110, and the grasping or gripping of each one of the pair of oppositely disposed, transversely oriented edge, lip, or tab portions 114,116 by means of the gripper bar mechanism or assembly of the motorized transport vehicle, some of the upwardly and downwardly projecting cleats 120,122 disposed upon the pair of oppositely disposed, transversely oriented edge, lip, or tab portions 114,116 will be partially collapsed or compressed as a result of their encounter with the gripper bar mechanism or assembly. Accordingly, such partially collapsed or compressed cleats 120,122 will effectively exhibit different height or thickness dimensions with respect to the non-collapsed or non-compressed cleats 120,122 thereby effectively presenting irregular surface regions, with respect to the non-collapsed or non-compressed cleats 120, 122 whereby the overall pattern of the cleats 120,122 will, again, create and enhance frictional characteristics between the cleats 120,122 and the gripper bar mechanism or assembly.

It has been noted, with respect to the existence or formation of the upwardly and downwardly projecting collapsible or compressible cleats 118 upon both the upper and lower surface regions of the primary central planar portion 112 of the pallet sheet 110, as well as with respect to the respective existence or formation of the upwardly and downwardly projecting collapsible or compressible cleats 120,122 upon both the upper and lower surface portions of the pair of oppositely disposed, transversely oriented edge, lip, or tab members 114,116, that the cleats 118,120,122 all comprise convex structures. Therefore, since, for example, the upwardly projecting collapsible or compressible cleats 118,120,122 disposed upon the upper surface region of the primary central planar portion 112 of the pallet sheet 110, and upon the upper surface portions of the pair of oppositely disposed, transversely oriented edge, lip, or tab members 114,116, effectively define upwardly oriented convex structures, the corresponding undersurface or lower surface regions of the primary central planar portion 112 of the pallet sheet 110, and the pair of oppositely disposed, transversely oriented edge, lip, or tab members 114,116 effectively define concave structures.

Accordingly, when the plurality of downwardly projecting collapsible or compressible cleats 118,120,122 are provided upon the lower or undersurface region of the primary central planar portion 112 of the pallet sheet 110, and upon the lower or undersurface portions of the pair of oppositely disposed, transversely oriented edge, lip, or tab members 114,116, they will be formed at locations different from those locations at which the plurality of upwardly projecting collapsible or compressible cleats 118,120,122 are provided upon the upper region of the primary central planar portion 112 of the pallet sheet 110, and upon the upper surface portions of the pair of oppositely disposed, transversely oriented edge, lip, or tab members 114,116, such as, for example, within alternating or respectively interposed rows or the like. For example, while the plurality of angled rows of the upwardly projecting cleats 118, disposed upon the upper surface region of the primary central planar portion 112 of the pallet sheet 110, as disclosed within FIG. 2, may be located or spaced apart from each other by means of a distance of two inches (2.00"), the plurality of angled rows of the downwardly projecting cleats 118, disposed upon the lower or undersurface region of the primary central planar portion 112 of the pallet sheet 110 may likewise be located or spaced apart from each other by, for example, means of a distance of two inches (2.00"), however, the loci of the rows of the upwardly and downwardly projecting cleats 118 will be offset from each other by means of a distance of, for example, one inch (1.00") such that the rows of the plurality of downwardly projecting cleats 118, disposed upon the lower or undersurface region of the primary central planar portion 112 of the pallet sheet 110, will effectively be interposed between the loci of the rows of the plurality of upwardly projecting cleats 118, disposed upon the upper surface region of the primary central planar portion 112 of the pallet sheet 110. Similar placement or formation techniques apply to the provision of the cleats 120,122 upon the lower or undersurface portions of the pair of oppositely disposed, transversely oriented edge, lip, or tab members 114,116.

Figure 3:
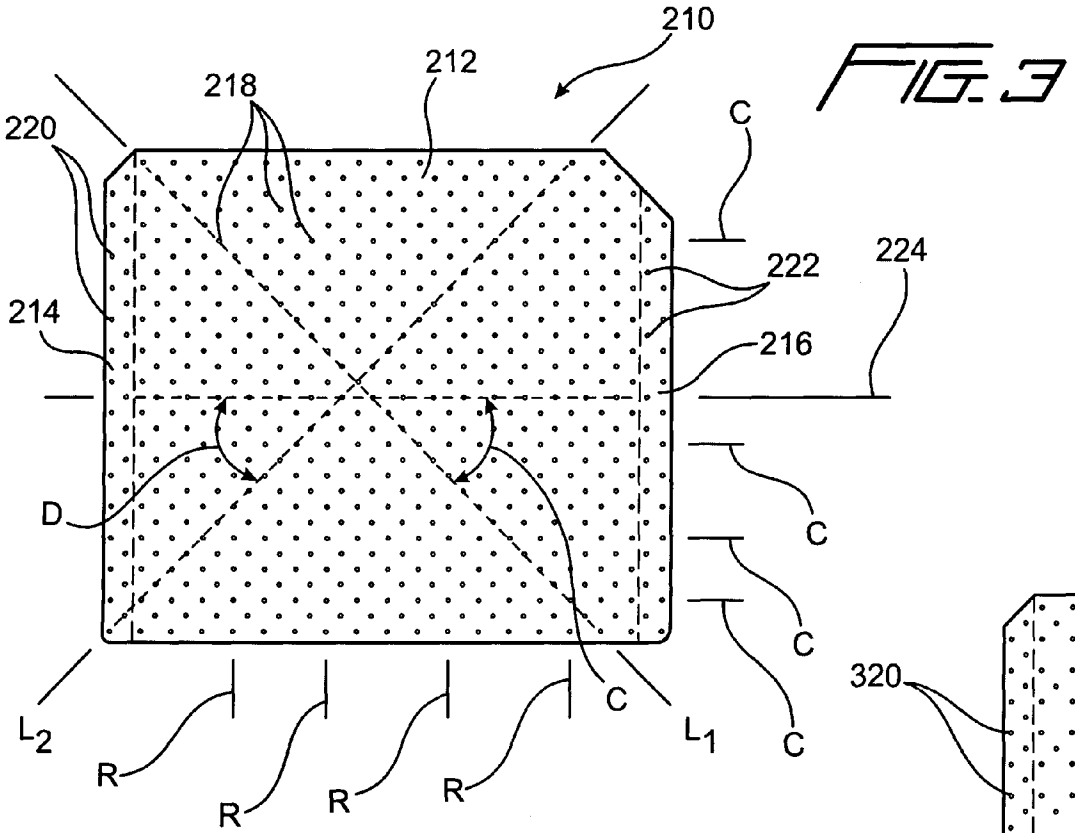
FIG. 3 is a bottom plan view of a second embodiment of a new and improved pallet sheet as constructed in accordance with the principles and teachings of the present invention and showing the cooperative parts thereof, wherein, in particular, the cleats, disposed upon the upper surface portion of the main central body portion of the pallet sheet, are arranged within a predetermined pattern comprising a plurality of parallel rows and columns.

With reference now being made to FIG. 3, a second embodiment of a new and improved pallet sheet, as constructed in accordance with the principles and teachings of the present invention and showing the cooperative parts thereof, is disclosed and is generally indicated by the reference character 210. It is initially noted that the second embodiment pallet sheet 210 as disclosed within FIG. 3 is substantially the same as the first embodiment pallet sheet 110 as disclosed within FIG. 2, except as will be noted hereinafter, and accordingly, those structural features comprising the second embodiment pallet sheet 210, which correspond to the structural features comprising the first embodiment pallet sheet 110, will be designated by means of corresponding reference characters except that they will be within the 200 series. More particularly, the only significant difference between the second embodiment pallet sheet 210 as disclosed within FIG. 3, as compared to the first embodiment pallet sheet 110 as disclosed within FIG. 2, resides in the fact that in lieu of providing, for example, the upwardly projecting cleats 118 upon the upper or top surface region of the primary central planar portion 112 of the pallet sheet 110 so as to be disposed within the aforenoted angled rows which extend along the parallel loci disposed at the angle B with respect to the longitudinal axis of the pallet sheet 110, it is seen that the upwardly projecting cleats 218 of the second embodiment pallet sheet 210 are provided upon the upper or top surface region of the primary central planar portion 212 of the pallet sheet 210 so as to be disposed within a plurality of longitudinally spaced rows R and a plurality of transversely spaced columns C with respect to the longitudinal axis 224 of the pallet sheet 210. Alternatively, it may be considered that the upwardly projecting cleats 218 of the second embodiment pallet sheet 210 are disposed within a plurality of mutually perpendicular rows and columns which are disposed along loci, as exemplified by means of $L_1$,$L_2$ which extend at mutually perpendicular angles C,D with respect to the longitudinal axis 224 of the pallet sheet 210. Similarly structured downwardly projecting cleats 218 can also be provided upon the lower or undersurface region of the primary central planar portion 212 of the pallet sheet 210.

Figure 4:
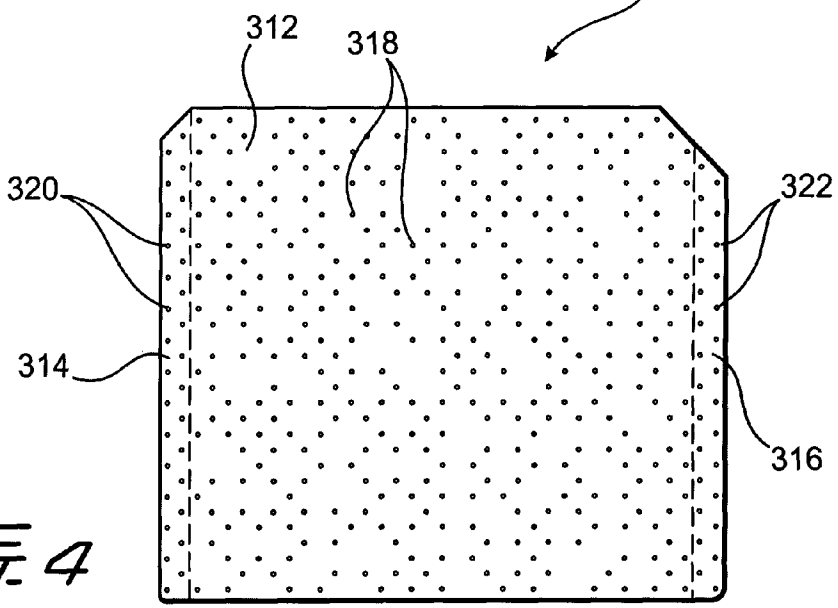
FIG. 4 is a bottom plan view of a third embodiment of a new and improved pallet sheet as constructed in accordance with the principles and teachings of the present invention and showing the cooperative parts thereof, wherein, in particular, the cleats, disposed upon the upper surface portion of the main central body portion of the pallet sheet, are arranged within a random pattern.

With reference now being made to FIG. 4, a third embodiment of a new and improved pallet sheet, as constructed in accordance with the principles and teachings of the present invention and showing the cooperative parts thereof, is disclosed and is generally indicated by the reference character 310. It is initially noted that the third embodiment pallet sheet 310 as disclosed within FIG. 4 is substantially the same as the first and second embodiment pallet sheets 110,210 as respectively disclosed within FIGS. 2 and 3, except as will be noted hereinafter, and accordingly, those structural features comprising the third embodiment pallet sheet 310, which correspond to the structural features comprising the first and second embodiment pallet sheets 110, 210 will be designated by means of corresponding reference characters except that they will be within the 300 series. More particularly, the only significant difference between the third embodiment pallet sheet 310 as disclosed within FIG. 4, as compared to the first and second embodiment pallet sheets 110,210 as disclosed within FIGS. 2-3, resides in the fact that in lieu of providing the upwardly, or downwardly, projecting cleats 118,218 within the aforenoted angled rows, or rows and columns, it is to be appreciated that the upwardly, or downwardly, projecting cleats 318 of the third embodiment pallet sheet 310 are provided upon the upper, or lower, surface regions of the primary central planar portion 312 of the pallet sheet 310 in accordance with a totally random pattern.

Figure 5:
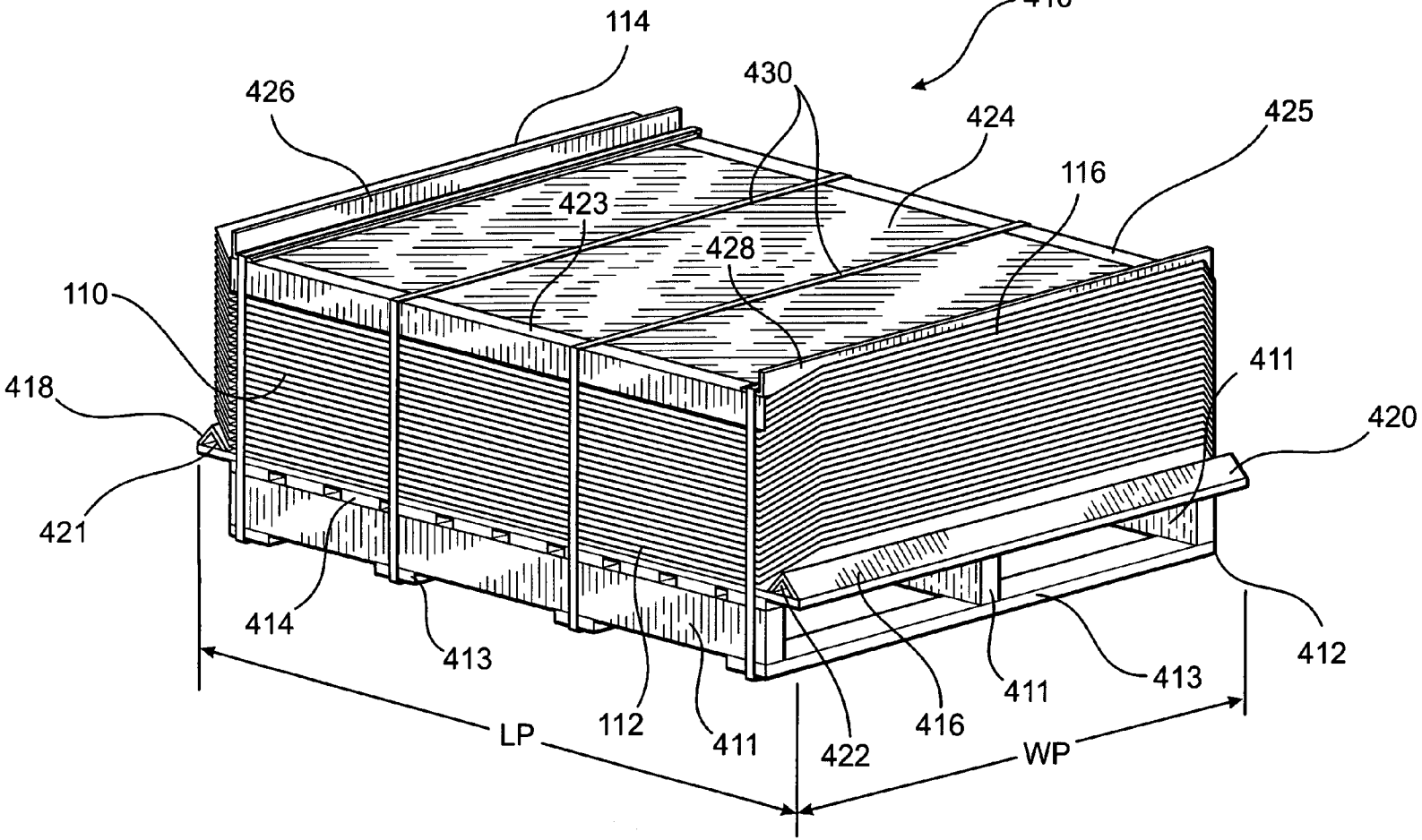
FIG. 5 is a perspective view of a palletized support assembly upon which a plurality of the new and improved pallet sheets of the present invention may be disposed and packaged during storage and shipping so as to ensure the fact that the oppositely disposed edge, lip, or tab portions of the pallet sheets are disposed and retained at a predeterminedly upward angle so as to facilitate their subsequent usage as pallet sheets.

With reference lastly being made to FIG. 5, there is disclosed a new and improved palletized support assembly upon which a plurality of any one of the new and improved pallet sheets 110,210,310 of the present invention may be disposed and packaged so as to ensure the fact that the oppositely disposed edge, lip, or tab portions 114,214,314,116, 216,316 of the pallet sheets 110,210,310 are disposed and retained at their predeterminedly upward angles so as to facilitate the gripping or grasping of the same by means of the motorized transport vehicle gripper bar mechanism or assembly when the pallet sheets are to be used beneath palletized loads, the palletized support assembly being generally designated by the reference character 410. More particularly, it is seen that the new and improved palletized support assembly 410 comprises a base pallet frame structure 412, formed by means of a plurality of longitudinally extending frame members 411, a plurality of lower transversely extending frame members 413 upon which the lower end portions of the longitudinally extending frame members 411 are disposed, and a plurality of upper transversely extending frame members 414 fixedly connected to the upper end portions of the longitudinally extending frame members 411. A support platform 416 is fixedly secured atop the plurality of upper transversely extending frame members 414, and it is seen that the support platform 416 has a length dimension LP and a width dimension WP which is substantially the same as, or just slightly larger than, the respective length and width dimensions L,W of each one of, for example, the pallet sheets 110, as disclosed within FIG. 2, such that when a plurality of the pallet sheets 110 are disposed upon the support platform 416 in the illustrated stacked array, all of the primary central planar portions 112 of the pallet sheets 110 will be properly supported upon the support platform 416 in a substantially nested manner.

In addition, it is also seen that in accordance with the unique and novel structural features of the present invention, a pair of transversely oriented, angled structures 418,420, such as, for example, angle boards, angle irons, solid structures having an angled side or wall member, or the like, are fixedly secured atop opposite end portions of the support platform 416 such that apex or corner portions of, for example, the transversely oriented, inverted angle boards or angle irons 418,420, which integrally interconnect together the leg members of the angle boards or angle irons 418, 420, point or project upwardly. In this manner, one of the leg members 421,422 of each one of the transversely oriented, inverted angle boards or angle irons 418,420 faces inwardly toward, and will be disposed at a 45° angle with respect to, the central region of the support platform 416. Therefore, as can also be readily appreciated from FIG. 5, when the plurality of pallet sheets 110 are disposed upon the palletized support assembly 410, wherein the plurality of primary central planar portions 112 of the pallet sheets 110 are disposed atop the support platform 416 in their nested state, the pair of oppositely disposed, transversely oriented edge, lip, or tab members 114,116 of the pallet sheets 110 will be disposed upon the inwardly facing, angled leg members 421,422 of the angle boards or angle irons 418,420 such that the pair of oppositely disposed, transversely oriented edge, lip, or tab members 114, 116 of the pallet sheets 110 will be supported by the inwardly facing, angled leg members 421,422 of the angle boards or angle irons 418,420 and thereby ensure that each one of the pair of oppositely disposed, transversely oriented edge, lip, or tab members 114,116 of the pallet sheets 110 will be maintained at their 45° angular orientation during storage and shipping.

In this manner, when a particular one of the pallet sheets 110 is removed from its storage location in preparation for use as a pallet sheet in connection with the preparation of a palletized load, the pair of oppositely disposed, transversely oriented edge, lip, or tab members 114,116 of the pallet sheet 110 will already be disposed at their proper angular orientation for engagement by means of the gripper bar mechanism or assembly of a motorized transport vehicle. As can be further appreciated from FIG. 5, the palletized support assembly 410 is completed by means of an upper sheet structure 424 disposed atop the uppermost one of the pallet sheets 110, a first upper pair of angle boards or angle irons 423,425 disposed along the longitudinally extending sides of the plurality of stacked pallet sheets 110, a second upper pair of angle boards or angle irons 426,428 disposed along the transversely extending ends of the plurality of stacked pallet sheets 110 and atop the opposite ends of the first upper pair of angle boards or angle irons 423,425, and a plurality of binding straps or the like 430 encircling the entire palletized support assembly 410 so as to fixedly retain all of the components thereof together.

Thus, it may be seen that in accordance with the principles and teachings of the present invention, there has been provided a new and improved pallet sheet which has a substantially rectangular configuration and which comprises a substantially planar, centrally located base region, and a pair of upwardly angled edge, lip, or tab portions which are respectively integrally formed upon, and extend along, each one of the pair of oppositely disposed, transversely oriented, relatively short ends or sides of the rectangularly configured pallet sheet so as to facilitate the engagement of the pallet sheet by means of a suitable gripper bar mechanism of a motorized transport vehicle. The upper surface portion of the pallet sheet is provided with a plurality of upwardly oriented collapsible or compressible cleats wherein the upwardly oriented cleats disposed upon the upper surface portion of the pallet sheet provide cushioning and enhanced frictional characteristics between the pallet sheet and the cargo load. Still further, upwardly and downwardly oriented cleats are also disposed upon the upper and lower surface portions of the upwardly angled edge, lip, or tab portions of the pallet sheet so as to provide enhanced gripping characteristics for the pallet sheet when one of the upwardly angled edge, lip, or tab portions is grippingly engaged by means of the gripper bar mechanism of the motorized transport vehicle during either the pulling or pushing phase of a palletized load loading or unloading operation. Still yet further, a support system, comprising a cargo support pallet, is provided for supporting a plurality of pallet sheets thereon in a nested mode during storage and shipping. Oppositely disposed end portions of the cargo pallet are respectively provided with angled structures wherein apex or corner portions of the angled structures are oriented upwardly. In this manner, when the oppositely disposed edge, lip, or tab portions of the plurality of pallet sheets engage the angled wall or leg members of the angled structures, the oppositely disposed edge, lip, or tab portions will be angled upwardly at a desired predetermined angle so as to retain the same at the predetermined angle, for gripping by the gripper bar mechanism of the motorized transport vehicle, when the pallet sheet is to be used in connection with the formation of palletized loads.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. In combination, a plurality of pallet sheets and a palletized support structure, upon which said plurality of pallet sheets, having oppositely disposed upwardly angled end tab members, are to be supported in a substantially nested stacked array, comprising:

a palletized support structure upon which a plurality of pallet sheets are to be disposed and supported;

a plurality of pallet sheets, having substantially rectangular configurations comprising predetermined length and width dimensions with oppositely disposed end portions of said plurality of pallet sheets having oppositely disposed, upwardly angled tab members that can be readily grasped by a gripper mechanism of a transport vehicle, disposed and supported upon said palletized support structure in a stacked nested array such that said stacked nested array of said plurality of pallet sheets substantially defines a rectangular parallelepiped;

said palletized support structure having predetermined width and length dimensions substantially corresponding to said predetermined length and width dimensions of said plurality of pallet sheets and comprising a substantially flat central planar portion for serving as an underlying support structure for substantially central planar portions of said plurality of pallet sheets, and a pair of angled structures, disposed only at opposite end portions of said substantially flat central planar platform of said palletized support structure so as to effectively leave said substantially flat central planar platform of said palletized support structure free to support said substantially central planar portions of said plurality of pallet sheets in a substantially planar state, while said pair of angled structures engage said oppositely disposed end portions of said plurality of pallet sheets, having said predetermined length dimensions, so as to cause said oppositely disposed end portions of said plurality of pallet sheets, comprising said oppositely disposed, upwardly angled tab members, to be maintained in such upwardly angled orientation such that said plurality of pallet sheets can be readily grasped by a gripper mechanism of a transport vehicle, and wherein said plurality of pallet sheets will be able to be disposed and maintained upon said palletized support structure in said substantially nested stacked array; and fastening members for securing and retaining said nested stacked array of said plurality of pallet sheets upon said underlying palletized support structure.

2. The combination as set forth in claim 1, wherein:

said fastening members for securing and retaining said nested stacked array of said plurality of pallet sheets upon said palletized support structure comprises a plurality of binding straps.

3. The combination as set forth in claim 1, wherein:

said pair of angled structures respectively have triangular cross-sectional configurations.

4. The combination as set forth in claim 3, wherein:

said pair of angled structures respectively comprise angle boards comprising a pair of leg members and apex portions integrally interconnecting said pair of leg members together, and wherein said angle boards are inverted such that said apex portions extend upwardly and one of said pair of leg members is disposed at a predetermined angle so as to maintain said oppositely disposed upwardly angled end tab members of the plurality of pallet sheets at the predeterminedly upward angle.

5. The combination as set forth in claim 4, wherein:

said predetermined angle, at which said one of said pair of leg members is disposed, comprises 45°.

6. The combination as set forth in claim 3, wherein:

said pair of angled structures respectively comprise angle irons comprising a pair of leg members and apex portions integrally interconnecting said pair of leg members together, and wherein said angle irons are inverted such that said apex portions extend upwardly and one of said pair of leg members is disposed at a predetermined angle so as to maintain said oppositely disposed upwardly angled end tab members of the plurality of pallet sheets at the predeterminedly upward angle.

7. The combination as set forth in claim 6 wherein:

said predetermined angle, at which said one of said pair of leg members is disposed, comprises 45°.

8. The combination as set forth in claim 3, wherein:

said pair of angled structures respectively comprise solid structures each comprising an angled wall member disposed at a predetermined angle so as to maintain said oppositely disposed upwardly angled end tab members of the plurality of pallet sheets at the predeterminedly upward angle.

9. The combination as set forth in claim 8, wherein:

said predetermined angle, at which said angled wall member is disposed, comprises 45°.

10. The combination as set forth in claim 1, wherein:

said predetermined length and width dimensions of each one of said plurality of pallet sheets comprises a length dimension of approximately fifty-one inches (51.00") and a width dimension of approximately forty-three inches (43.00").

* * * * *